US007894618B2

(12) United States Patent
Carr

(10) Patent No.: US 7,894,618 B2
(45) Date of Patent: Feb. 22, 2011

(54) APPARATUS COMPRISING A DIRECTIONALITY-ENHANCED ACOUSTIC SENSOR

(75) Inventor: Dustin Wade Carr, Albuquerque, NM (US)

(73) Assignee: Symphony Acoustics, Inc., Rio Rancho, NM (US)

( * ) Notice: Subject to any disclaimer, the term of this patent is extended or adjusted under 35 U.S.C. 154(b) by 1243 days.

(21) Appl. No.: 11/460,626

(22) Filed: Jul. 28, 2006

(65) Prior Publication Data

US 2008/0025545 A1 Jan. 31, 2008

(51) Int. Cl.
*H04R 25/00* (2006.01)

(52) U.S. Cl. ..... 381/172; 381/173; 381/174

(58) Field of Classification Search ..... 381/313, 381/171, 172, 35, 356, 357; 600/526, 528
See application file for complete search history.

(56) References Cited

U.S. PATENT DOCUMENTS 3,662,124 A * 5/1972 Hassler et al. ..... 381/357
3,995,124 A 11/1976 Gabr
4,933,545 A * 6/1990 Saaski et al. ..... 250/227.14
4,983,824 A 1/1991 Saaski et al.
5,128,537 A 7/1992 Halg
5,526,430 A 6/1996 Ono et al.
5,589,689 A 12/1996 Koskinen
5,793,875 A 8/1998 Lehr et al.
5,831,262 A 11/1998 Greywall et al.
5,909,280 A 6/1999 Zavracky
6,321,010 B1 11/2001 Walker et al.
6,483,619 B1 11/2002 Greywall
6,567,572 B2 5/2003 Degertekin et al.
7,146,014 B2 12/2006 Hannah
2003/0038949 A1 2/2003 Degertekin et al.
2003/0133588 A1 7/2003 Pedersen
2003/0156722 A1 * 8/2003 Taenzer ..... 381/92

(Continued)

FOREIGN PATENT DOCUMENTS

EP 0228677 A 7/1987
WO 2006062120 A 6/2006

OTHER PUBLICATIONS

Moscu, Viorel, "International Application No. PCT/US2007/074517; International Search Report and Written Opinion"; Date of Mailing: Feb. 28, 2008; Publisher: PCT.

(Continued)

*Primary Examiner*—Brian Ensey
(74) *Attorney, Agent, or Firm*—DeMont & Breyer, LLC

(57) ABSTRACT

An apparatus and method for discriminating a directional component of a propagating pressure wave using an array of operatively-coupled displacement sensors are disclosed. In accordance with the illustrative embodiment, each displacement sensor in the array comprises two parallel layers, at least one of which is movable. The output signal of each displacement sensor is based on the separation of the layers. The displacement sensors are operatively-coupled through a compressible fluid such that the response of one of the sensors to an input can cause an output signal in at least one of the other sensors. The operative-coupling of the displacement sensors amplifies relative phase information between their respective output signals, which results in improved directionality. Some embodiments of the present invention are particularly well-suited for use in microphones.

33 Claims, 8 Drawing Sheets

U.S. PATENT DOCUMENTS

| | | | | |
|---|---|---|---|---|
| 2003/0198359 | A1 * | 10/2003 | Killion et al. | 381/313 |
| 2004/0099799 | A1 | 5/2004 | Shinzou | |
| 2004/0130728 | A1 | 7/2004 | Degertekin et al. | |
| 2005/0018541 | A1 | 1/2005 | Johansen et al. | |
| 2005/0105098 | A1 | 5/2005 | Johansen et al. | |

OTHER PUBLICATIONS

Viorel Moscu, "International Application No. PCT/US2007/074517 International Preliminary Report on Patentability", Oct. 21, 2008, Publisher: PCT.

Sagberg, et al., Optical Microphone Based on a Modulated Diffractive Lens, IEEE Photonics Technology Letters, vol. 15, No. 10, Oct. 2003, pp. 1431-1433.

Cui, et al., Optical Sensing in a Directional MEMS Microphone Inspired by the Ears of the Parasitoid Fly, *Ormia ochracea*, IEEE, MEMS 2006, Instanbul, Turkey, Jan. 22-26, 2006.

Van Den Bogaert, et al., Distortion of Interaural Time Cues by Directional Noise Reduction Systems in Modern Digital Hearing Aids, 2005 IEEE Workshop on Applications of Signal Processing to Audio and Acoustics, Oct. 16-19, 2005, New Paltz, NY.

* cited by examiner

APPARATUS COMPRISING A DIRECTIONALITY-ENHANCED ACOUSTIC SENSOR

FIELD OF THE INVENTION

The present invention relates to displacement sensors in general, and, more particularly, to microphones.

BACKGROUND OF THE INVENTION

Hearing aids are worn by millions of hearing-impaired people. A hearing aid receives input sound, amplifies it, and retransmits the amplified sound to the ear of its user via a loudspeaker. The hearing aid uses a microphone to receive sound and a loudspeaker to retransmit it.

A microphone is a type of "displacement" sensor. The hearing aid represents only one of many important applications for displacement sensors; other applications include precision measurement systems, pressure sensors, and non-hearing aid microphones.

Advancements in microphone technology have led to vast improvements in the performance of state-of-the-art hearing aids. But there is still room for significant performance improvement.

Until recently, the microphones used in hearing aids have been "omni-directional" microphones. An omni-directional microphone typically comprises a single displacement sensor whose sensitivity is substantially uniform for sound arriving from any direction. As a result, hearing-aid wearers often have difficulty understanding speech in noisy environments due to the fact that hearing aids simply amplify all received sound, including background noise and echoes.

The use of a directional microphone offers a hearing aid user an improved ability to understand speech. A directional microphone has a sensitivity that is higher for sound that arrives from directions within a "reception cone" than outside of it. As a result, the use of a hearing aid with a directional microphone can: 1) improve the signal-to-noise ratio for desired speech by focusing reception in the direction of the person speaking; 2) reduce the effects of reverberation by attenuating sound arriving from directions outside the reception cone; and 3) reduce feedback effects that occur between the hearing aid's loudspeaker and microphone.

A typical directional microphone uses an array of omni-directional microphone elements. The operation of a microphone array as a directional microphone relies on the fact that sound propagates in the form of a pressure wave. Microphone directionality is derived by sensing a difference in amplitude of the received pressure wave (i.e., a gradient in pressure) between neighboring microphones in an array. When a sound wave arrives at the microphone array at an angle, each element in the microphone array senses the wave at a slightly different time. At one instant in time, therefore, each microphone element sees a different point on the wave. In other words, the wave hits each microphone element at a different "phase" of its wavelength.

Since the input sound hits each microphone in the array at a different phase, the output signal of each microphone element is also at a slightly different phase. A signal processor receives these output signals and applies an appropriate phase shift to each so that they combine constructively for sound received along only desired directions. In similar fashion, an appropriate phase shift can be applied to each output signal so that they combine destructively for sound received along all undesired directions. The microphone array, therefore, can have selectively-improved sensitivity for sound arriving from only certain directions (i.e., directionality). Through the use of a sophisticated signal processing system, this technique enables a directional microphone to: 1) discriminate input sound arriving from only one particular direction; or 2) follow a moving transmitter; or 3) scan the microphone system's surroundings to align to a particular direction.

The directional sensitivity of a microphone array is a function of the ratio between the spacing of the array elements and the wavelength of the sound being received. The larger this ratio, the better the directional discrimination that can be achieved by the directional microphone. Unfortunately, for many directional microphone applications in the prior-art, and in particular for hearing aid applications, the spacing between microphones in an array is limited to only a few millimeters, while the wavelengths of the sound waves in the range of human hearing are on the order of tens of millimeters. The phase difference between the responses of two neighboring microphones, therefore, is extremely small. As a result, the directional performance of prior art microphone arrays has been disappointing.

Other factors have served to degrade the performance of prior-art directional microphones as well. First, a large portion of the input signal is lost in the process of the determining the directional component. Thus, the signal-to-noise ratio of the overall output signal is diminished. Second, the small spacing between microphones results in a directional component that is much smaller than the omni-directional component of the output signal. Also, the directional component decreases as the frequency of the sound decreases. Third, the sensors used in prior-art microphone arrays act as independent microphones, each of which outputs a signal based on the sound that is incident upon it. Unfortunately, the individual microphones also behave as independent noise sources. As a result, the noise contribution of the microphones to the overall output signal increases as the number of microphones in the array increases. As a result of these factors, prior-art directional microphone systems exhibit a signal-to-noise ratio that is worse than that of each individual sensor in the system. Finally, any mismatch in an operational characteristic of the microphones in the array degrades the performance of displacement sensor array further.

A displacement sensor array that generates a directionally-sensitive output signal with at least some of: a high signal; a high signal-to-noise ratio; reduced cost; and reduced complexity, would, therefore, be a significant advance in the art.

SUMMARY OF THE INVENTION

Embodiments of the present invention are capable of determining and/or discriminating a directional component of a propagating pressure wave without some of the costs and disadvantages for doing so in the prior art. Some embodiments of the present invention are particularly well-suited for use in directional-microphone, directional-pressure sensor, vibration-sensor, and pressure-gradient sensor applications.

In the prior art, an array of independently-operating displacement sensors receives input sound and generates a plurality of individual sensor output signals. The relative phase information (i.e., the phase differences) of the sensor output signals provides information pertaining to the directionality of the input sound. Signal processing techniques utilize this relative phase information to isolate a directional component of the output of the array. Because of the independent operation of these prior-art displacement sensors, however, the phase difference of the output signals is typically extremely small. The small phase difference limits the signal strength of the directional component of the output of the array. As a result, the directional performance of prior-art displacement sensor arrays has been disappointing.

In contrast, in the illustrative embodiment of the invention, an array of operatively-coupled displacement sensors receives input sound and generates a plurality of sensor output signals. The magnitude of the phase differences between the output signals from the sensors is enhanced by the operatively-coupled nature of the sensors. As a result, the signal strength of the directional component of the output of the array can be much larger than is achieved by prior-art directional microphones. This results in a greater signal-to-noise ratio and improved directionality relative to the prior art. And, importantly, the directional component is amplified without introducing additional noise to the output of the microphone system.

Furthermore, due to the operatively-coupled nature of the sensors in the array, the enhanced phase difference is achieved with considerably smaller element separation than is required for a non-operatively-coupled sensor array. A directional microphone according to the present invention, therefore, can be considerably smaller than directional microphones known in the prior-art.

Embodiments of the present invention comprise an array of displacement sensors. The output signal of each sensor is based on the separation between two substantially-parallel plates. Some embodiments of the present invention comprise displacement sensors which are operatively-coupled through a compressible fluid that is shared among the displacement sensors. Due to this operative-coupling, a change in the separation between the plates of a first displacement sensor can cause a change in the separation between the plates of a second displacement sensor. As a result, the relative phase information in the output signal from the displacement sensor array is amplified, which yields improved directional information for the incident pressure wave.

In some embodiments, each displacement sensor in the array comprises an optically-resonant cavity that is interrogated using an optical beam and photodetector array. In some embodiments, in addition to the use of the aforementioned optically-interrogated displacements sensors, the array will include one or more of the displacement sensors that are interrogated non-optically. In some further embodiments, the array of displacement sensors consists exclusively of operatively coupled, non-optically interrogated, displacement sensors. Non-optically-interrogated displacement sensors for use in the array include, without limitation, displacement sensors based on:

i. piezoelectric technology; or ii. electret technology; or iii. capacitance; or iv. energy-resonant cavity technology; or v. any combination of i, ii, iii, and iv.

An embodiment of the present invention comprises: (1) a first sensor for generating a first output signal based on an environmental stimulus, wherein the first sensor comprises a first movable layer and a first surface, and wherein the first movable layer and the first surface are substantially parallel and form a first cavity having a first cavity length, and further wherein the first output signal is a function of the first cavity length; and (2) a second sensor for generating a second output signal based on the environmental stimulus, wherein the second sensor comprises a second movable layer and a second surface, and wherein the second movable layer and the second surface are substantially parallel and form a second cavity having a second cavity length, and further wherein the second output signal is a function of the second cavity length; wherein the first sensor and the second sensor are physically-adapted to be operatively-coupled through a compressible fluid.

DETAILED DESCRIPTION

The following terms are defined for use in this Specification, including the appended claims:

Fabry-Perot etalon means an optically-resonant cavity formed by two substantially parallel and substantially flat surfaces that are separated by a cavity-length, wherein the cavity-length is fixed.

Fabry-Perot interferometer means an optically-resonant cavity formed by two substantially parallel and substantially flat surfaces that are separated by a cavity-length, wherein the cavity-length is not fixed. Examples include arrangements of plates wherein the cavity-length is controllably-varied using an actuator, as well as arrangements wherein the cavity-length can vary in response to a stimulus, such as incident acoustic energy.

Cavity-length means the instantaneous separation between two substantially parallel and substantially flat surfaces that form an optically-resonant cavity. Cavity-length is fixed in the case of an etalon. Cavity-length is variable in the case of an interferometer, such as a Fabry-Perot interferometer.

Reflected means reflected externally to an element. A beam reflected by an element, for example, undergoes a change in propagation direction, due to interaction with the element, of at least 90 degrees. It does NOT mean energy that reflects internally within the element. For example, reflected energy from an optically-resonant cavity means light reflected away from a surface of the cavity, not light reflecting between the two surfaces that form the cavity.

Transmitted means not reflected externally to or absorbed by an element. A transmitted beam undergoes a change in propagation direction of less than 90 degrees after interaction with the element. Examples of transmitted beams include, without limitation: a light beam that passes completely through a lens, dielectric layer, or material; a light beam that is refracted by a prism; and, light that passes through at least one surface that forms an optically-resonant cavity.

Reflective-surface means a surface that reflects a significant amount of optical energy at the wavelength or wavelengths suitable for an application.

Operatively-coupled means that the operation of one device affects another device, wherein the devices need not be physically-coupled or even mechanically-coupled. For example, a laser and a mirror are operatively coupled if a laser directs a beam of light to the mirror.

Energy-resonant cavity means two spaced-apart surfaces which are semi-transparent to an energy, wherein the spacing between the two surfaces defines a cavity length, and wherein its transmissivity and/or reflectivity for the energy is a function of the cavity length of the energy-resonant cavity. Examples of energy-resonant cavities include: a Fabry-Perot etalon, a Fabry-Perot interferometer, etc.

Figure 1:
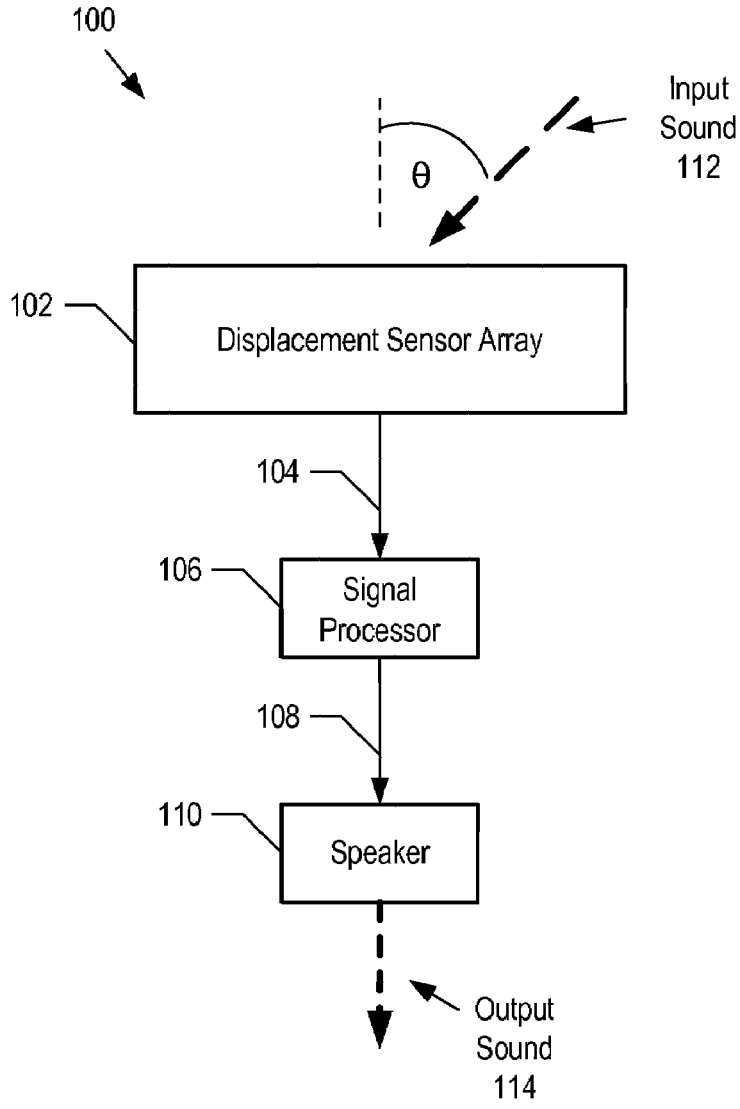
FIG. 1 depicts a schematic diagram of the salient components of a hearing aid with directional sensitivity in accordance with an illustrative embodiment of the present invention.

FIG. 1 depicts a schematic diagram of the salient components of a hearing aid with directional sensitivity in accordance with an illustrative embodiment of the present invention. Hearing aid 100 receives acoustic energy in the form of input sound 112, which has an angle of incidence, θ (measured from the normal), and provides acoustic energy in the form of output sound 114. Output sound 114 is influenced by a directional component of input sound 112.

Hearing aid 100 comprises displacement sensor array 102, signal processor 106, and speaker 110.

Displacement sensor array 102 is an array of sensors located in sensor regions. Each sensor comprises two substantially parallel surfaces separated by a cavity length. The output signal of each sensor in displacement sensor array 102 is a function of the instantaneous separation between its two surfaces (i.e., instantaneous cavity length). The sensor regions of displacement sensor array 102 are operatively-coupled, such that the movement of the movable layer of one sensor region can cause a physical response in at least one other displacement sensor of displacement sensor array 102. Displacement sensor array 102 will be described in detail below and with respect to FIGS. 3, 4, and 5*a*.

Signal processor 106 is a processing system that receives sensor signal 104 and performs signal processing on it. Sensor signal 104 comprises output signals from individual sensors of displacement sensor array 102. Signal processor 106 comprises an analog-to-digital converter, a digital signal processor, and a digital-to-analog converter. Signal processor 106 provides electrical signal 108 to speaker 110, wherein electrical signal 108 is conditioned to provide:

i. enhanced signal strength; or
ii. improved signal clarity; or
iii. reduced signal noise; or
iv. a directionally-adapted signal; or
v. any combination of i, ii, iii, and iv.

Speaker 110 is an acoustic transducer for converting an electrical signal into acoustic energy.

Figure 2:
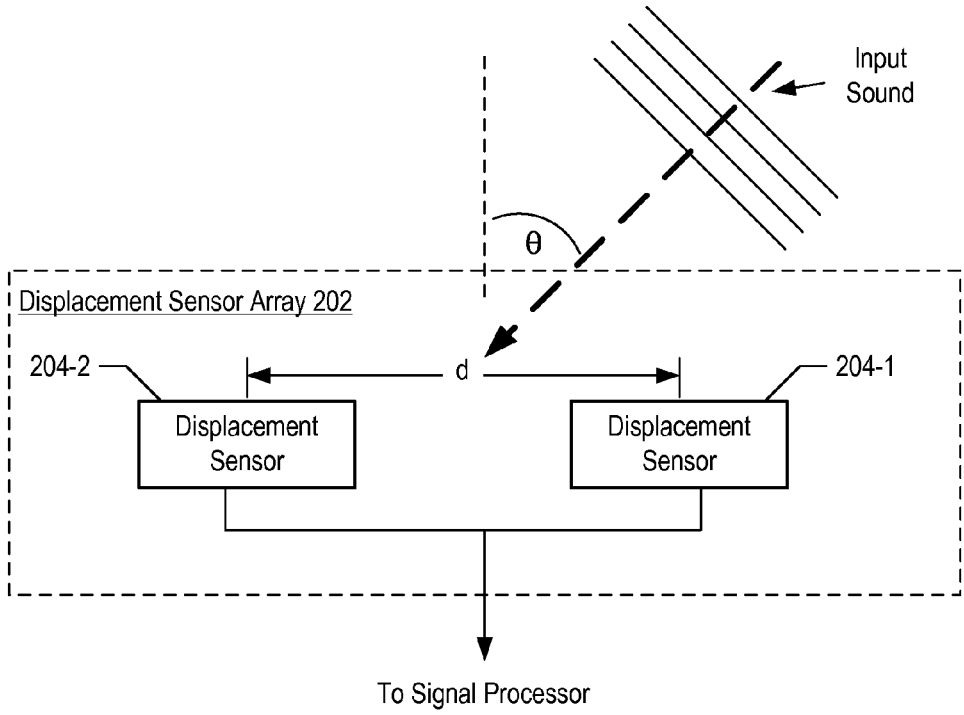
Figure 2 (Prior Art)
FIG. 2 depicts a schematic diagram of the salient components of the input stage of a directionally-sensitive receiver for a hearing aid system as is known in the prior art.

FIG. 2 depicts a schematic diagram of the salient components of the input stage of a directional microphone for a hearing aid system as is known in the prior art. Displacement sensor array 202 comprises displacement sensors 204-1 and 204-2. Displacement sensors 204-1 and 204-2 are mounted on fixed spacing, d, and operate independently of one another. In other words, the output signal of displacement sensor 204-1 has no dependency on the response of displacement sensor 204-2 (and vice versa).

Displacement sensor arrays in the prior art have utilized such technologies as capacitive displacement sensors, electret displacement sensors, piezoelectric displacement sensors, etc. Typically, these displacement sensors, referred to as input ports, have a center-to-center spacing, d, of around 1 centimeter due to the requirements of the human ear or other practical limitations. Input sound, however, is characterized by a wavelength that is much larger than the separation of a typical prior-art displacement sensor array. For example, sound having a frequency of 1 kHz in air has a wavelength of approximately 330 mm. This disparity in port separation vs. wavelength results in a loss of overall signal strength and poor directionality performance overall.

In the prior art, the directionality of an input sound is determined purely through signal processing, based on the phase differences of the input sound at each displacement sensor. The phase difference of the input sound is then translated into a phase difference in the output electrical signals from the individual displacement sensors in the array.

At any point, x, and time, t, the instantaneous amplitude of a propagating pressure wave associated with sound can be described as:

$$A(x,t)=A_o e^{i(kx*\cos\theta-t)}, \tag{1}$$

where:

$A_o$ is the amplitude of the sound wave in units of pressure;
k is the wavenumber ω/c;
ω is the frequency of sound;
c is the speed of sound in the medium; and
θ is the angle of incidence (measured from the direction of normal incidence) of the input sound.

The sound pressure level at the two displacement sensors 204-1 and 204-2, expressed as $A_1$ and $A_2$, respectively, can be described by the expressions:

$$A_1=A_o\sin(\omega t)+\omega\tau A_o\cos(\omega t) \tag{2}$$

$$A_2=A_o\sin(\omega t)-\omega\tau A_o\cos(\omega t), \tag{3}$$

where: τ is the time required for the pressure wave associated with the input sound to traverse the distance from displacement sensor 204-1 to displacement sensor 204-2. τ is determined by the geometry of displacement sensor array 202 and the speed of the acoustic energy and can be described as:

$$\tau=\frac{d}{2c}\cos(\theta) \tag{4}$$

The directional sensitivity of a microphone system for which displacement sensor 202 is the input is determined by a signal processor, and is based on the difference in the phases of sound pressures, $A_1$ and $A_2$. This phase difference results in a term that has a dipole response with angle, the resolution of which is a function of the center-to-center spacing, d.

The performance of prior-art directional microphones is degraded by several factors. First, since the first terms of equations (2) and (3) cancel out in when the difference is taken, a large portion of the signal is lost in the process of the determining the directional component. Second, since $\omega\tau<<1$, the directional component of the signal is much smaller than the omni-directional component. Also, the directional component decreases with increasing sound frequency. Third, since sensors 204-1 and 204-2 are completely independent, they behave as independent noise sources. The overall noise of a sensor system therefore increases by a factor of $\sqrt{N}$, where N is the number of sensors in the sensor array.

As a result of these factors, prior-art directional microphones have a signal-to-noise ratio (SNR) that is greatly reduced from that of each individual displacement sensor in the system. Finally, any mismatch in an operational characteristic of displacement sensors 204-1 and 204-2 will further degrade the performance of displacement sensor array 202.

Figure 3A:
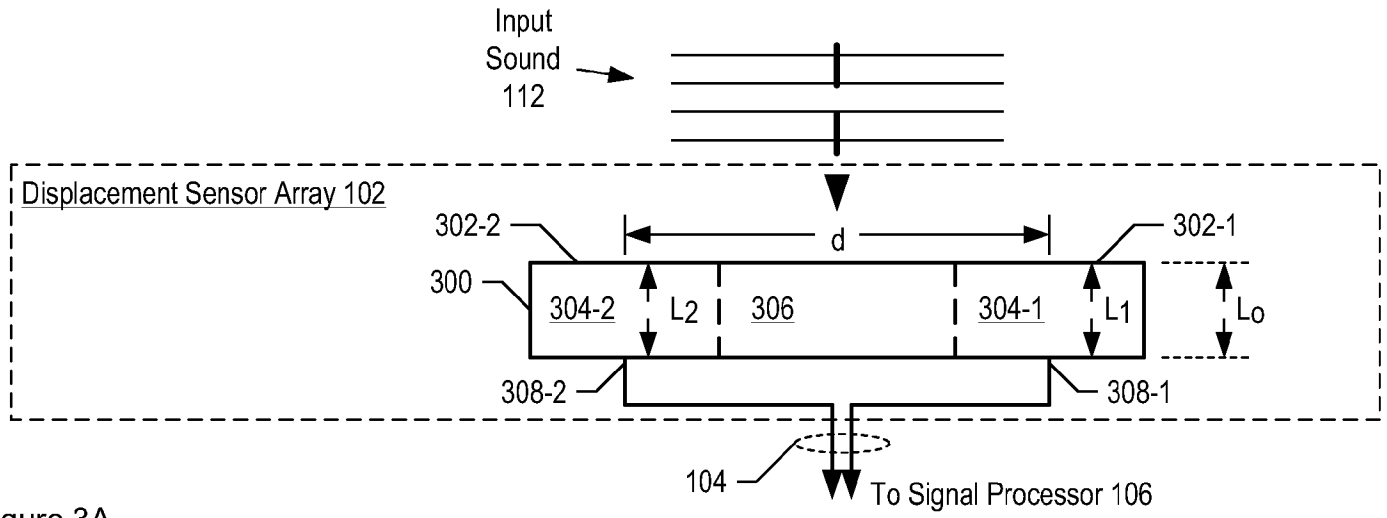
FIG. 3A depicts a schematic view of the salient components of a displacement sensor array in accordance with the illustrative embodiment of the present invention.

FIG. 3A depicts a schematic view of the salient components of a displacement sensor array in accordance with the illustrative embodiment of the present invention. Displacement sensor array 102 is shown receiving input sound 112 that is incident from the direction normal to the plane of the sensor array (i.e., $\theta=0°$). Displacement sensor array 102 comprises displacement sensor 302-1, displacement sensor 302-2, and conduit 306.

Displacement sensor 302-1 is located in sensor region 304-1 in chamber 300 and displacement sensor 302-2 is located in sensor region 304-2 in chamber 300. Displacement sensors 302-1 and 302-2 each comprise two substantially parallel surfaces which are separated by initial cavity length, $L_o$. The initial cavity length is the distance between the two parallel surfaces in the absence of a deforming force, such as a pressure wave that is incident on one of the surfaces. In typical operation, sensor regions 304-1 and 304-2 are filled with air; however, it will be clear to those skilled in the art, after reading this specification, how to make and use alternative embodiments of the present invention in which sensor regions are filled with a different type of compressible fluid.

In order to provide sensing capability, one of the two parallel surfaces of each of displacement sensors 302-1 and 302-2 is a surface of a movable layer. These movable layers move in response to receiving acoustic energy, thereby changing the instantaneous cavity length of their respective displacement sensors. Output signal 308-1 is a function of the instantaneous cavity length, $L_1$, of displacement sensor 302-1. In similar fashion, output signal 308-2 is a function of the instantaneous cavity length, $L_2$, of displacement sensor 302-2. Displacement sensors 302-1 and 302-2 are described in more detail below and with respect to FIGS. 4 and 5*a*.

Conduit 306 is a substantially rigid region of chamber 300 that enables flow of fluid (e.g., air, etc.) between displacement sensors 302-1 and 302-2. Displacement sensors 302-1 and 302-2 are, therefore, operatively-coupled via the compressible fluid within chamber 300. As will be described in detail below and with respect to FIG. 4, air flows through conduit 306 in response to out-of-phase motion of the movable layers of each displacement sensor. The directional response of displacement sensor array 102 is improved due to this operative-coupling of displacement sensors 302-1 and 302-2.

When displacement sensor array 102 receives input sound 112, where $\theta=0°$, all displacement sensors in the array are subject to the pressure wave at the same time. The movable layers of displacement sensors 302-1 and 302-2, therefore, respond simultaneously (i.e., in-phase). This in-phase deflection of the movable layers of displacement sensors 302-1 and 302-2 causes a reduction in the total volume of chamber 300.

The amount of deflection of the movable layer of a displacement sensor is a function of its mechanical modulus, K. The mechanical modulus of a displacement sensor is a linear coefficient that translates a change in pressure into a change in deflection as:

$$K = -\frac{dP}{dL}. \tag{5}$$

Since chamber 300 contains a compressible fluid (e.g., air, etc.) and since displacement sensors 302-1 and 302-2 are operatively-coupled through this compressible fluid, the mechanical modulus, K, of displacement sensors 302-1 and 302-2 is a function of both (1) the mechanical modulus, $K_m$, of their respective movable layer and (2) the mechanical modulus, $K_a$ of air within the chamber. Thus: $K=K_m+K_a$.

For practical displacement sensors suitable for use in displacement sensor array 102, the volume of chamber 300 is sufficiently small that the isothermal compressibility of the air in chamber 300 results in a very large $K_a$. For typical displacement sensor arrays, the initial cavity length, $L_o$, is less than or equal to about 100 microns; therefore $K_a$ is much greater than $K_m$. Thus, K is approximately equal to $K_a$. As a result, the response of displacement sensor array 102 to input sound incident in the normal direction is dominated by the mechanical modulus of the compressible fluid itself and the mechanical modulus of the movable layer can be ignored.

Figure 3B:
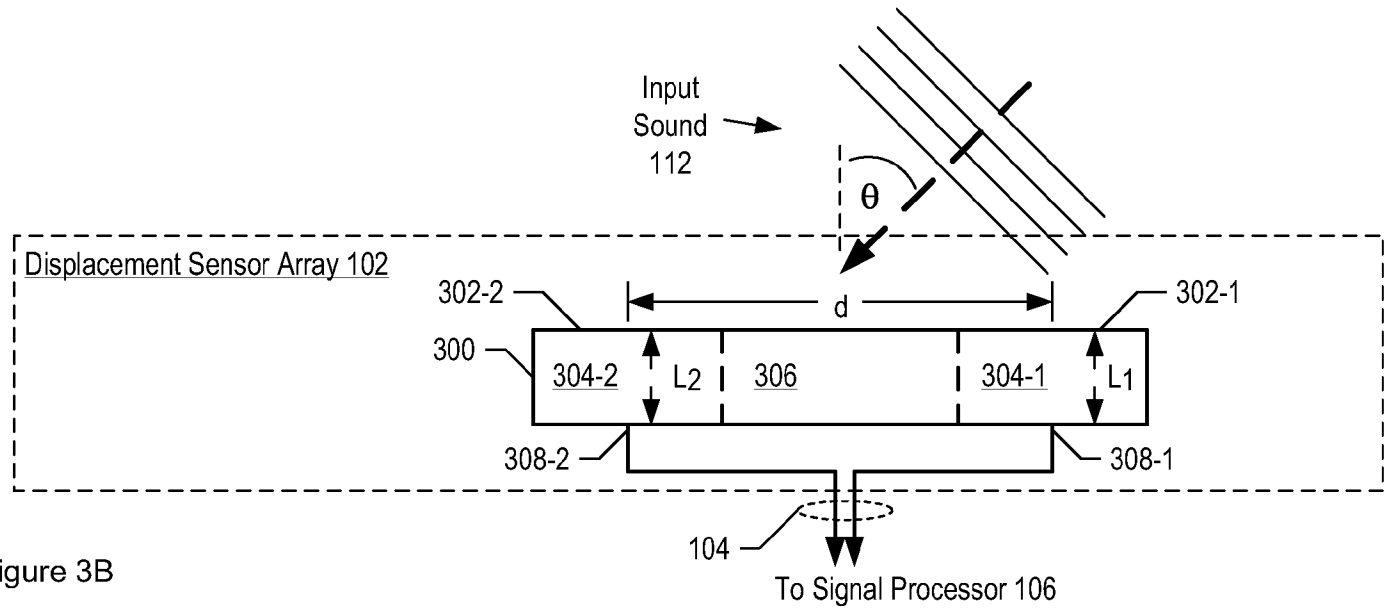
FIG. 3B depicts a schematic view of the salient components of a displacement sensor array in accordance with the illustrative embodiment of the present invention.

FIG. 3B depicts a schematic view of the salient components of a displacement sensor array in accordance with the illustrative embodiment of the present invention. Displacement sensor array 102 is shown receiving input sound that is incident at a non-normal direction to the plane of the sensor array; that is, $\theta\neq0°$.

Since input sound 112 is received by displacement sensor array 102 at non-normal angle in this embodiment, displacement sensor 302-1 receives a pressure wave associated with input sound 112 before displacement sensor 302-2. When it receives the pressure wave, the movable layer of displacement sensor 302-1 is pushed inward. As a result, the cavity length, $L_1$, of displacement sensor 302-1 is reduced. As cavity length $L_1$ is reduced, some of the compressible fluid from sensor region 304-1 is driven into sensor region 304-2 through conduit 306. As a consequence, the movable layer of displacement sensor 302-2 moves in a manner opposite to the movable layer of displacement sensor 302-1; therefore, cavity length, $L_2$, of displacement sensor 302-2 is increased. If the motion of the movable layers of displacement sensors 302-1 and 302-2 is equal and opposite, then the total cavity volume remains unchanged and K reduces to $K_m$ for each displacement sensor.

The operation of displacement sensor array 102 is analogous to the behavior of a partially-inflated balloon. Under uniformly-applied pressure, the stiffness of the balloon will be dominated by the compressibility of the gas inside of it. But when only a portion of the balloon is compressed, the gas is driven into the uncompressed portion, which then expands. In this latter case, the stiffness of the balloon is dominated by the stiffness of the balloon wall. If the balloon is made of a thick, strong material, it will be difficult to compress. If the balloon is made of a thin, highly-compliant material, it will compress more easily.

The terms corresponding to the directional component of the response of displacement sensor array 102 to input sound 112 (as derived from equations (2) and (3) above) are equal and opposite in magnitude. When expressed in terms of membrane deflection, u, equations (2) and (3) become:

$$u_r(t) = \frac{A_o}{K_a + K_m}\sin(\omega t) + \frac{A_o}{K_m}\omega\tau\cos(\omega t), \quad (6)$$

and $$u_l(t) = \frac{A_o}{K_a + K_m}\sin(\omega t) - \frac{A_o}{K_m}\omega\tau\cos(\omega t). \quad (7)$$

As a result, the relative phase information between output signals 308-1 and 308-2, which compose sensor signal 104, is amplified by a factor of $$\left(\frac{K_a + K_m}{K_m}\right).$$

Figure 4:
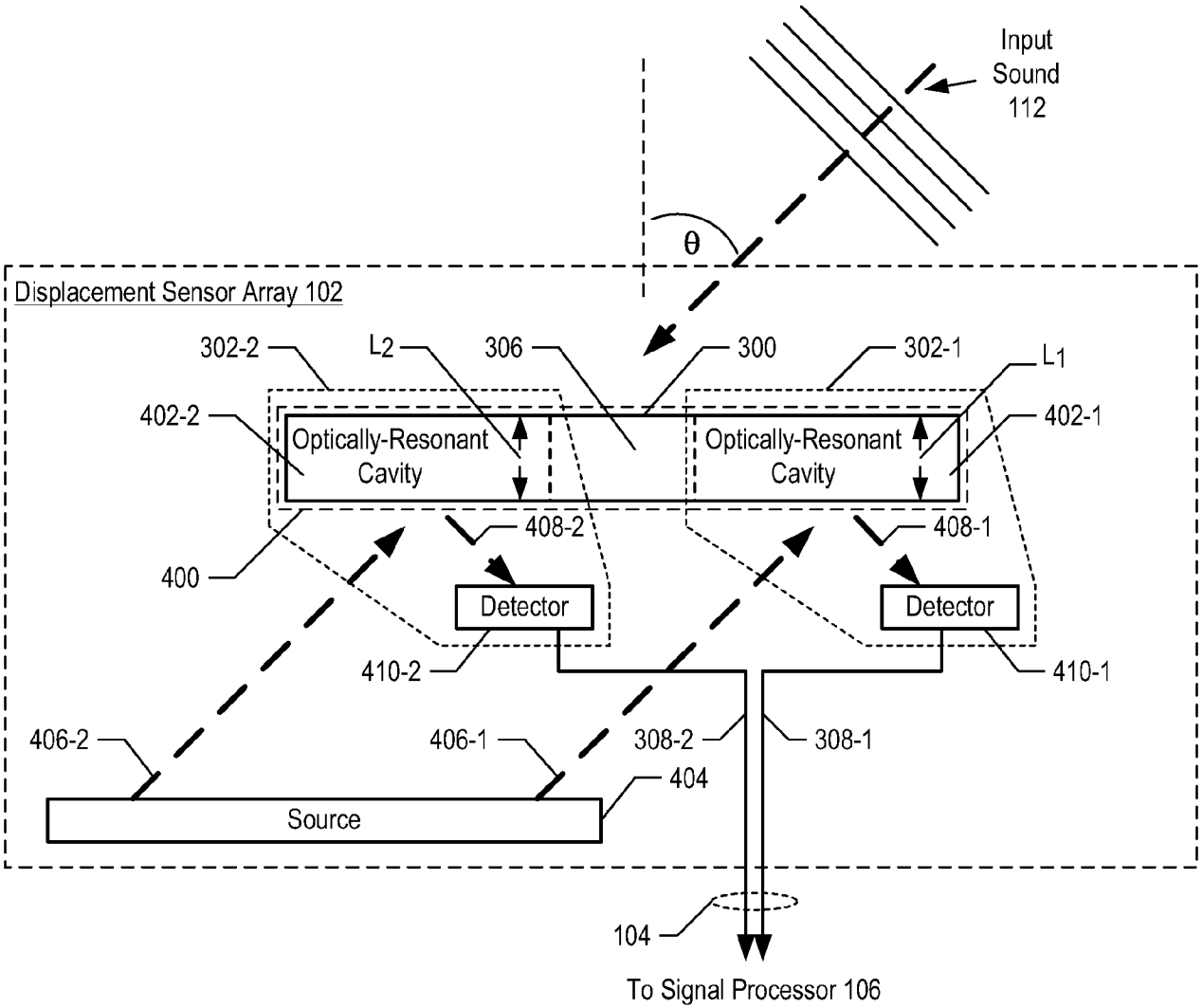
FIG. 4 depicts details of an embodiment of displacement sensor array 102 in accordance with the illustrative embodiment of the present invention.

FIG. 4 depicts details of an embodiment of displacement sensor array 102 in accordance with the illustrative embodiment of the present invention. In the embodiment that is depicted in FIG. 4, displacement sensor array 102 comprises optically-resonant cavity array 400, source 404, detector 410-1, and detector 410-2. Optically-resonant cavity array 400 comprises optically-resonant cavities 402-1 and 402-2, which are operatively-coupled via a compressible fluid through conduit 306. Optically-resonant cavities 402-1 and 402-2 are optically-resonant at an operating wavelength, λ.

Optically-resonant cavity 402-1, together with source 404 and detector 410-1, compose displacement sensor 302-1. Optically-resonant cavity 402-1 distributes the optical energy of input beam 406-1 into reflected beam 408-1 and into a first transmitted beam (not shown). Input beam 406-1 comprises light that is characterized by an operating wavelength, λ. The distribution of the optical energy in reflected beam 408-1 and in the first transmitted beam is a function of the operating wavelength and the instantaneous cavity length, $L_1$, of optically-resonant cavity 402-1.

In similar fashion, optically-resonant cavity 402-2, together with source 404 and detector 410-2, compose displacement sensor 302-1. Optically-resonant cavity 402-2 distributes the optical energy of input beam 406-2 into reflected beam 408-2 and into a second transmitted beam (not shown). Input beam 406-2 comprises light that is characterized by operating wavelength, λ. The distribution of the optical energy in reflected beam 408-2 and in the second transmitted beam is a function of the operating wavelength and the instantaneous cavity length, $L_2$, of optically-resonant cavity 402-2.

Source 404 is a laser diode capable of emitting monochromatic light at an operating wavelength, λ, (e.g., such as at an operating wavelength, λ, of 850 nanometers (nm)), with a spectral-width of less than ten (10) nm, and preferably less than three (3) nm.

In some embodiments of the present invention, source 404 comprises a light-emitting diode. In some other embodiments, source 404 comprises a super-luminescent light-emitting diode. In some further embodiments of the present invention, source 404 comprises a narrow-wavelength-band filter that reduces the spectral bandwidth of source 404. Source 404 comprises an optional integrated lens array for collimating input beams 406-1 and 406-2. In some alternative embodiments, the optical energy that is output by source 404 is collimated by external bulk optic lenses, in well-known fashion.

In the illustrative embodiment, a single source of optical energy, (i.e., source 404) provides input beams 406-1 and 406-1 (referred to collectively as "input beams 406"), which are used to interrogate the entire optically-resonant cavity array 400. It will be clear to those skilled in the art, after reading this specification, how to make and use alternative embodiments of the present invention that utilize multiple sources to provide input beams 406.

Each of optically-resonant cavities 402-1 and 402-2 is formed with an initial cavity length, $L_o$ such that the reflectivity of the cavity is approximately 50%. As such, each of optically-resonant cavities 402-1 and 402-2 reflects approximately half of the light it receives in the absence of incident acoustic energy. In other words, in the absence of incident acoustic energy, the intensity of output beam 408-1 is approximately half of the intensity of input beam 406-1 and the intensity of output beam 408-2 is approximately half of the intensity of input beam 406-2. Since the reflectivity response of an optically-resonant cavity is sinusoidal in nature, an initial reflectivity of 50% provides optically-resonant cavities 402-1 and 402-2 with as large a dynamic range as possible for both the increasing reflectivity and decreasing reflectivity directions. It will be clear to those skilled in the art after reading this specification, however, how to make and use alternative embodiments of the present invention in which optically-resonant cavities 402-1 and 402-2 are formed with other initial cavity-lengths. Furthermore, it will be clear to those skilled in the art, after reading this specification, how to make and use alternative embodiments of the present invention that operate at operating wavelengths other than 850 nm. Embodiments of displacement sensors 302-1 and 302-2 are described in U.S. patent application Ser. No. 11/366,730, filed Mar. 2, 2006, Ser. No. 11/278,990, filed Apr. 7, 2006, and Ser. No. 11/421,593, filed Jun. 1, 2006, each of which is incorporated in its entirety by reference herein.

Although in the illustrative embodiment, displacement sensor array 102 comprises displacement sensors that comprise optically-resonant cavities, it will be clear to those skilled in the art, after reading this specification, how to make and use alternative embodiments of the present invention wherein displacement sensor array 102 comprises any combination of displacement sensors whose output is a function of the movement of a movable layer. Examples of suitable displacement sensors for inclusion in displacement sensor array 102 include, without limitation, displacement sensors based on capacitor plates, electrets, piezo-electrics, laser vibrometers, resonant cavities that are resonant for forms of energy other than light, and magnetic pick-up coils operatively coupled to a movable layer.

As described above and with respect to FIG. 3B, displacement sensor array 102 receives input sound 112, which is directed at the array at angle $\theta \neq 0$ (with respect to the direction normal to the plane of the sensor array). As a function of its angular orientation, a pressure wave associated with input sound 112 is incident on displacement sensor 302-1 before displacement sensor 302-2. Motion of the movable layer of optically-resonant cavity 402-1 causes a pressure increase within chamber 300. Since optically-resonant cavities 402-1 and 402-2 are operatively-coupled through the air contained in chamber 300, the increased pressure within chamber 300 induces a sympathetic and opposite motion of the movable layer of optically-resonant cavity 402-2. As a result, output signal 308-1 changes in the opposite sense of output signal 308-2 and signal processor 106 is provided a differential signal, 104, from displacement sensor array 102 which results in an enhancement of up to 20 dB in directional sensitivity.

Figure 5:
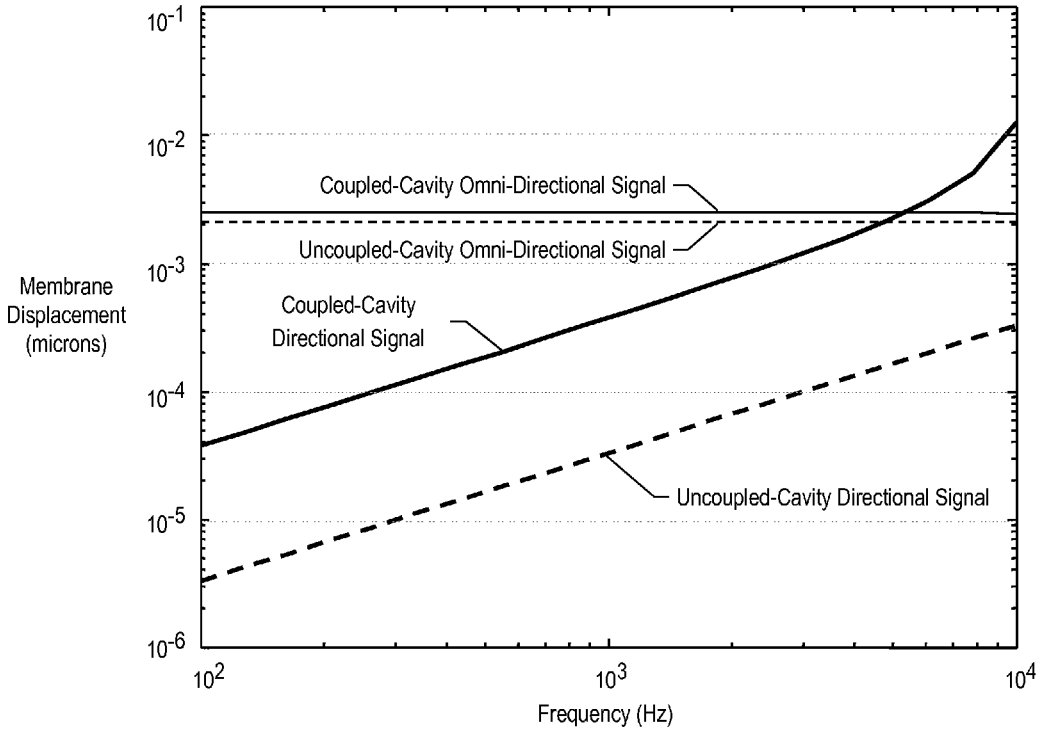
FIG. 5 shows a computational model for (1) an optically-resonant cavity pair that is operatively-coupled in accordance with the illustrative embodiment of the present invention and (2) a non-operatively-coupled optically-resonant cavity pair.

FIG. 5 shows a computational model for (1) an optically-resonant cavity pair that is operatively-coupled in accordance with the illustrative embodiment of the present invention and (2) a non-operatively-coupled optically-resonant cavity pair.

The omni-directional signal of a cavity pair is the sum of the displacements of its two movable layers. The directional signal of a cavity pair is the net difference of the displacements of its two movable layers. In each case, operatively-coupled and non-operatively coupled, the center-to-center spacing of the cavities is 2.5 mm, and the angle of incidence, θ, of the input sound is 45°.

In each case, the omni-directional output signal is approximately the same. However, the directional output signal is substantially improved for the operatively-coupled cavity pair. The factor of 10 improvement in membrane displacement differential results in an approximately 20 dB improvement in directional output signal. In addition, it should be noted that the improvement in differential signal for the operatively-coupled case results in a directional output signal that is higher than the omni-directional output signal for frequencies above approximately 5 kHz.

Figure 6A:
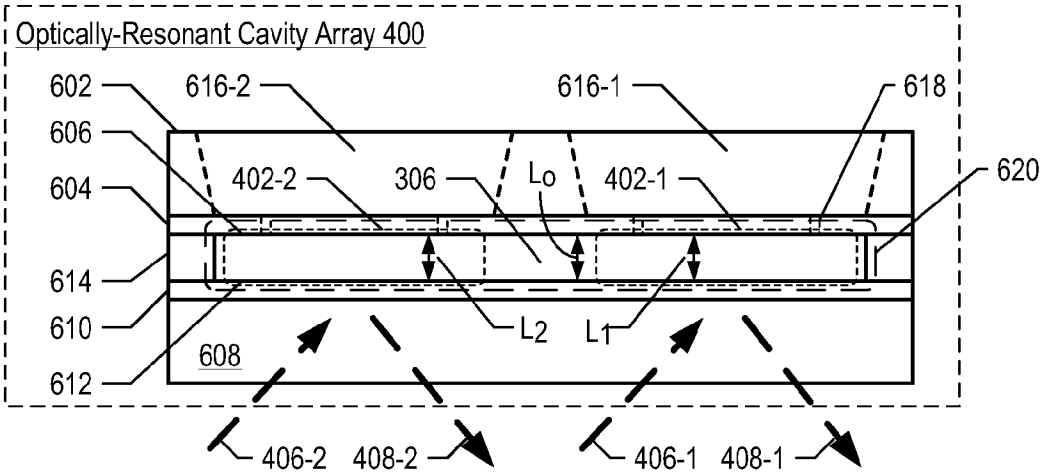
FIG. 6A depicts a cross-sectional view of an operatively-coupled optically-resonant cavity array in accordance with the illustrative embodiment of the present invention.

FIG. 6A depicts a cross-sectional view of an operatively-coupled optically-resonant cavity array in accordance with the illustrative embodiment of the present invention. Optically-resonant cavity array 400 comprises first substrate 602, first dielectric layer 604, second substrate 608, second dielectric layer 610, and spacer layer 614.

In the embodiment that is depicted in FIG. 6A, first substrate 602 is a silicon substrate that has been etched to form access holes 616-1 and 616-2. In some embodiments, the silicon substrate has a thickness of about 500 microns.

First dielectric layer 604 is a layer of material that is translucent at the operating wavelength, λ. First dielectric layer 604 comprises surface 606. First dielectric layer 604 has a thickness of approximately n*λ/4, where λ is measured within layer 604 and n is an odd-integer. In some embodiments of the present invention, first dielectric layer 604 comprises a layer of silicon-rich silicon nitride (SiRN) that has a thickness of about 100 nm.

By virtue of the formation of access holes 616-1 and 616-2 in substrate 602, membrane regions are formed in first dielectric layer 604. The membrane regions are substantially mechanically-isolated from one another (except as operatively-coupled by air, etc., through conduit 306) by the portion of substrate 602 that remains between access holes 616-1 and 616-2. Each of these membrane regions composes the respective movable layer of optically-resonant cavities 402-1 and 402-2. As a result, they comprise the movable layers in displacement sensors 302-1 and 302-2, as described above and with respect to FIGS. 3A and 3B. First dielectric layer 604 comprises optional through-holes 618 to facilitate response of optically-resonant cavities 402-1 and 402-2 to changes in pressure (e.g., in order to provide or avoid mechanical damping effects, etc.). It will be appreciated by those skilled in the art that the inclusion and/or design of through-holes 618 affect the interaction of operatively-coupled displacement sensors 302-1 and 302-2. The specific design of through-holes 618, therefore, is application-dependent.

Second substrate 608 is a silicon substrate that, in some embodiments, has a thickness of about 500 microns. In some embodiments of the present invention, second substrate 608 is etched to form at least one access hole for input beams 406-1 and 406-2. Although the illustrative embodiment comprises first and second substrates that are silicon wafers, it will be clear to those skilled in the art, after reading this specification, how to make and use alternative embodiments of the present invention in which first and/or second substrates comprise materials other than silicon. Suitable materials for first or second substrate include, without limitation, glass, III-V compound semiconductors, II-VI compound semiconductors, ceramics, and germanium.

Second dielectric layer 610 is a layer of material that is translucent at operating wavelength, λ. Second dielectric layer 610 comprises surface 612. Second dielectric layer 610 has a thickness of approximately n*λ/4, where λ is measured within layer 610 and n is an odd-integer. In some embodiments of the present invention, second dielectric layer 610 comprises a layer of SiRN that has a thickness of about 100 nm. The regions of surface 612 within the confines of optically-resonant cavities 402-1 and 402-2 comprise the second of the two surfaces of these optically-resonant cavities. In some embodiments of the present invention, these regions of surface 612 are movable in response to incident acoustic energy.

Spacer layer 614 is a layer of silicon that is formed by etching a silicon wafer that interposes layers 604 and 610 to form chamber 620. The chamber comprises optically-resonant cavities 402-1 and 402-2 and conduit 306. In some embodiments, spacer layer 614 has a thickness of 110 microns.

In some embodiments, spacer layer 614 comprises a material other than silicon. Suitable materials for spacer layer 614 include, without limitation, ceramics, metals, organic compounds, resins, epoxies, solder, silicon dioxide, glass, alumina, III-V compound semiconductors, and II-VI compound semiconductors. Although the illustrative embodiment comprises a spacer layer that has a thickness of approximately 110 microns, it will be clear to those skilled in the art, after reading this specification, how to make and use alternative embodiments of the present invention that comprises spacers that have a thickness of other than 110 microns.

Hearing aid system 100, which is described above and with respect to FIG. 1, depicts the use of displacement sensor array 102 in dynamic-mode (i.e., operating as a directional microphone). In order to more clearly demonstrate the present invention, operation of displacement sensor 102 as a directional displacement sensor is described here, with reference to FIGS. 4, 6A, and 8.

Figure 8:
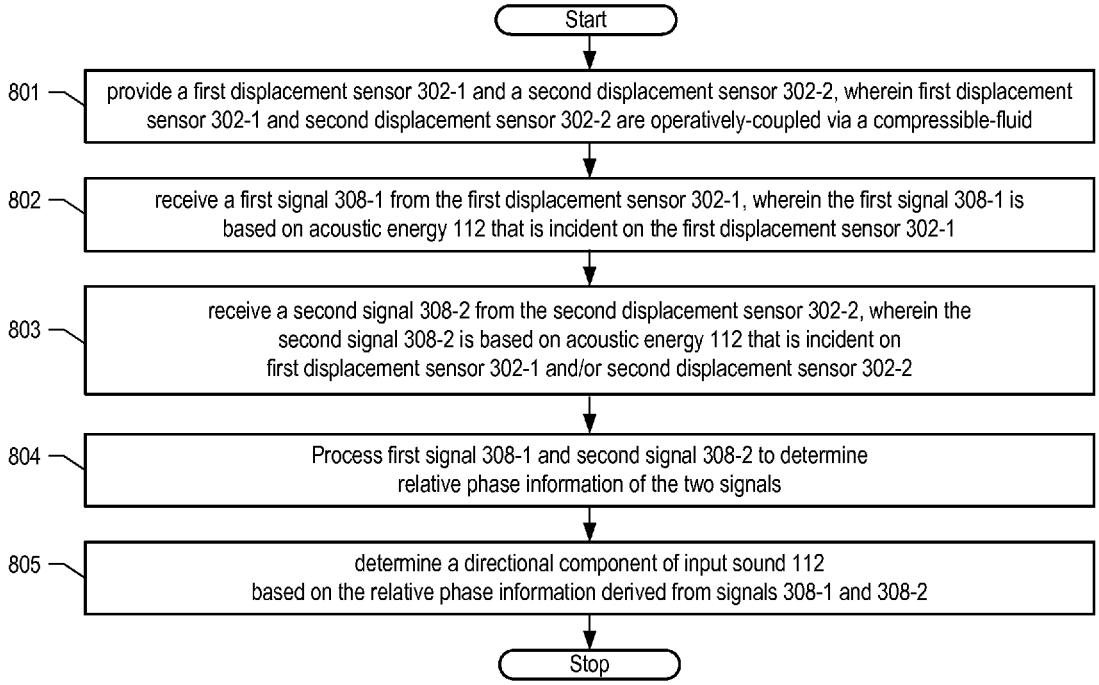
FIG. 8 depicts a flow chart that describes the determination of a directional component of input sound to a displacement sensor array, in accordance with the illustrative embodiment of the present invention.

As depicted in FIG. 8, at operation 801, displacement sensors 302-1 and 302-2 are provided such that they are operatively-coupled through a compressible fluid. Referring now to an embodiment that is depicted in FIG. 4, chamber 400 is a single chamber that includes two optically-resonant cavities, 402-1 and 402-2. Optically-resonant cavity 402-1 distributes optical energy from input beam 406-1 into output beam 408-1 as a function of its instantaneous cavity length, $L_1$. Similarly, optically-resonant cavity 402-2 distributes optical energy from input beam 406-2 into output beam 408-2 as a function of its instantaneous cavity length, $L_2$. Since, in this embodiment, chamber 400 is a single chamber, the two optically-resonant cavities are operatively-coupled through the compressible fluid (e.g., air, etc.) contained within chamber 400.

At operation 802, a pressure wave that is associated with input sound 112 is received by optically-resonant cavity 402-1. In response, instantaneous cavity length $L_1$ is reduced, thereby imprinting a signal on output beam 408-1. Output beam 408-1 is received by detector 410-1, which generates electrical output signal 308-1 based on the received intensity of output beam 408-1.

As cavity length $L_1$ is reduced by the incident pressure wave, air is driven from the region of optically-resonant cavity 402-1 into the region of optically-resonant cavity 402-2. This causes an increase in instantaneous cavity length $L_2$ of optically-resonant cavity 402-2.

At operation 803, the change in instantaneous cavity length $L_2$ imprints a signal on output beam 408-2. As the pressure wave associated with input signal 112 continues to propagate and is received by optically-resonant cavity 402-2, instantaneous cavity length $L_2$ decreases in response. This imprints an additional signal on output beam 408-2. Output beam 408-2 is received by detector 410-2, which generates electrical output signal 308-2 based on the received intensity of output beam 408-2.

At operation 804, signal processor 106 receives output signals 308-1 and 308-2 and processes these output signals to determine relative phase information of the two output signals.

At operation 805, signal processor 106 determines a directional component of input sound 112 based on the relative phase information derived from signals 308-1 and 308-2.

Figure 6B:
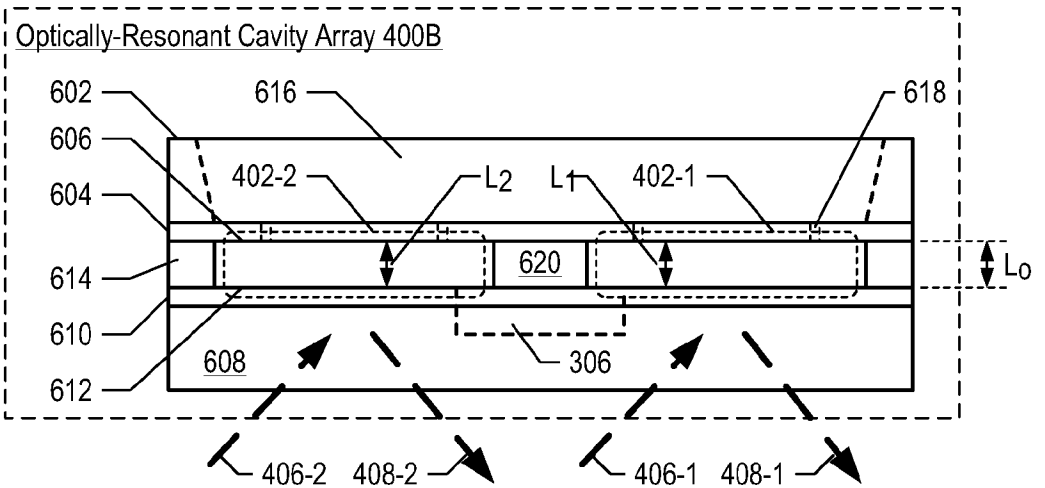
FIG. 6B depicts a cross-sectional view of an operatively-coupled optically-resonant cavity array in accordance with an alternative embodiment of the present invention.

FIG. 6B depicts a cross-sectional view of an operatively-coupled optically-resonant cavity array in accordance with an alternative embodiment of the present invention. Optically-resonant cavity array 400B comprises first substrate 602, first dielectric layer 604, second substrate 608, second dielectric layer 610, and spacer layer 614.

The structure and operation of optically-resonant cavity array 400B is substantially equivalent to optically-resonant cavity array 400 depicted in FIG. 6A with the exceptions that: 1) conduit 306 is formed by etching a channel into second substrate 608 to provide pneumatic communication between optically-resonant cavities 402-1 and 402-2; and 2) optically-resonant cavities 402-1 and 402-2 are mechanically isolated (except as operatively-coupled by air through conduit 306) from each other by wall 620. Wall 620 is a portion of spacer layer 614 that remains after spacer layer 614 is etched. Wall 620 spans the width of conduit 306. In some alternative embodiments, wall 620 does not extend the entire length between optically-resonant cavities 402-1 and 402-2 and the absent portion of wall 620 forms at least a portion of conduit 306.

Figure 7:
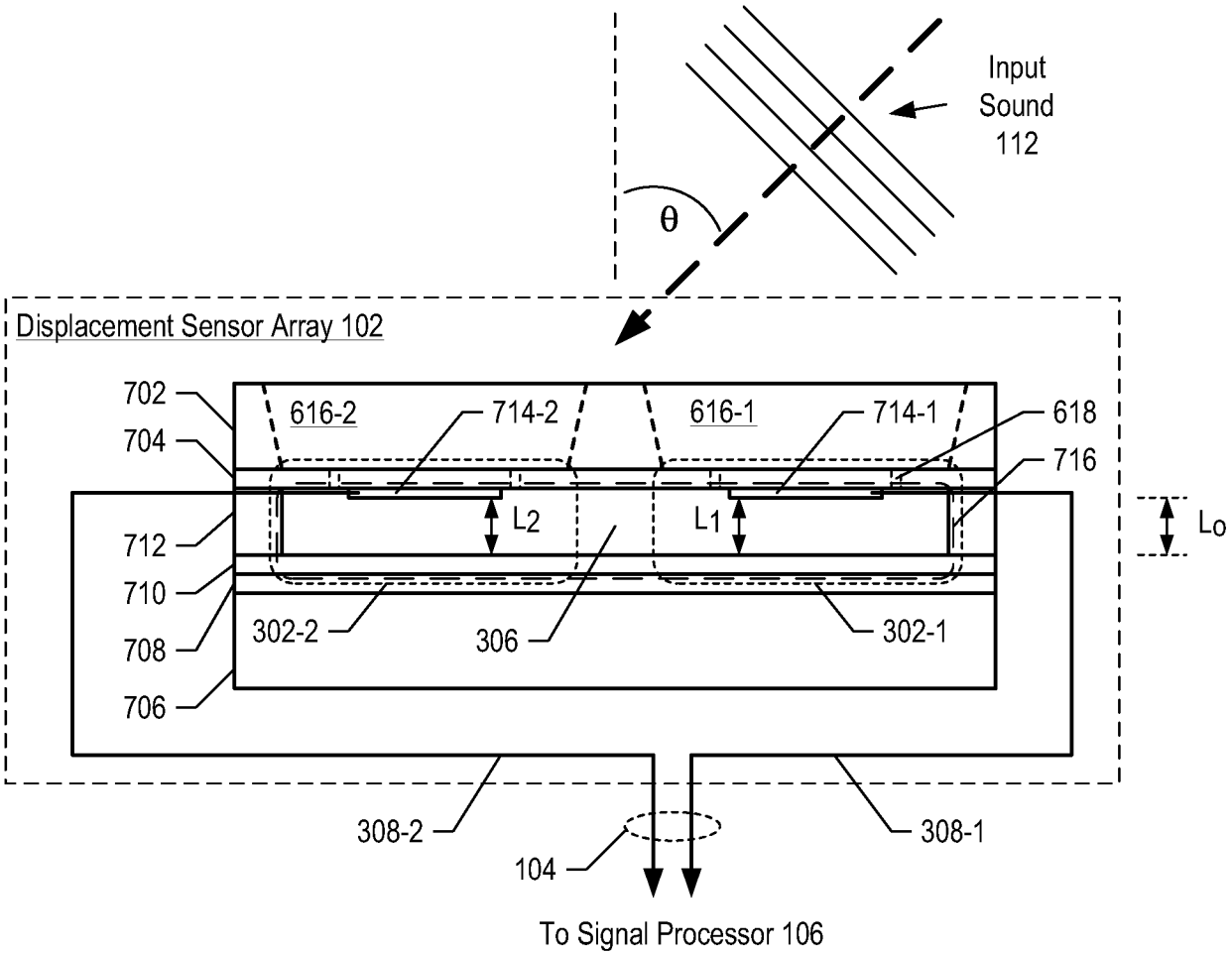
FIG. 7 depicts a cross-sectional view of a displacement sensor array according to an alternative embodiment of the present invention.

FIG. 7 depicts a cross-sectional view of a displacement sensor array according to an alternative embodiment of the present invention. Displacement sensor array 102 is an array of electret-based displacement sensors which are operatively-coupled through a compressible fluid that is contained within the array.

Arrays of independent electret-based displacement sensors are well-known in the prior-art. Electret-based displacement sensors provide an electrical output signal based on the separation between a permanently-charged dielectric (i.e., electret) and a sense electrode. The output signal of an electret-based displacement sensor is inversely proportional to the separation between the charged dielectric and the sense electrode. In order to form a microphone, either the charged dielectric or sense electrode is affixed to a movable layer or membrane that moves in response to incident acoustic energy. As a result, the instantaneous cavity length, L, of the electret-based displacement sensor (and, therefore, the output signal) changes as a function of the incident acoustic energy.

In accordance with the alternative embodiment of the present invention depicted in FIG. 7, the electret-based displacement sensors of displacement sensor array 102 are operatively-coupled through air contained within chamber 716. Displacement sensor array 102 comprises electret-based displacement sensors 302-1 and 302-2. Electret-based displacement sensor 302-1 comprises a first portion of first layer 704, on which is formed electrode 714-1, and the region of electret layer 710 located beneath electrode 714-1. Likewise, electret-based displacement sensor 302-2 comprises a second portion of first layer 704, on which is formed electrode 714-2, and the region of electret layer 710 located beneath electrode 714-2. First layer 704 is separated from electret layer 710 by spacer layer 712, such that electrodes 714-1 and 714-2 are separated from electret layer 710 by an initial cavity length, $L_o$.

First layer 704 is formed on first substrate 702. First substrate 702 is a silicon substrate which has been etched to form access-holes 616-1 and 616-2, and thereby form membrane regions for each of electret-based displacements sensors 302-1 and 302-2. In some embodiments, substrate 702 has a thickness of 500 microns.

First layer 704 is a layer of insulator material that provides sufficient strength to support electrodes 714-1 and 714-2, and simultaneously provides mechanical responsivity to incident acoustic energy. In some embodiments of the present invention, first layer 704 comprises a layer of SiRN that has a thickness of about 100 nm, although suitable materials include any insulator material that can be formed as a membrane capable of responding to incident acoustic energy.

By virtue of the formation of access holes 616-1 and 616-2 in substrate 702, membrane regions are formed in first layer 704. The membrane regions are substantially mechanically-isolated from one another (except as operatively-coupled by air through conduit 306) by the portion of substrate 702 that remains between access holes 616-1 and 616-2. Each of these membrane regions comprises one of the two electrodes 714-1 and 714-2. The membrane regions of first layer 704 are movable in response to incident acoustic energy and, therefore, comprise the movable layers in electret-based displacement sensors 302-1 and 302-2, as described above and with respect to FIGS. 3A and 3B. First layer 704 comprises optional through-holes 618 to facilitate response of electret-based displacement sensors 302-1 and 302-2 to changes in pressure (e.g., in order to provide or avoid mechanical damping effects, etc.).

Electret layer 710 is formed on dielectric layer 708, which is disposed on second substrate 706. Second substrate 706 is a 500 micron-thick silicon substrate. Although FIG. 7 depicts an alternative embodiment in which first and second substrate are silicon wafers, it will be clear to those skilled in the art, after reading this specification, how to make and use alternative embodiments of the present invention in which first and/or second substrates comprise materials other than silicon. Suitable materials for first or second substrate include, without limitation, glass, III-V compound semiconductors, II-VI compound semiconductors, ceramics, and germanium.

Dielectric layer 708 is a layer of insulator material suitable for isolating electret layer 710 from second substrate 706. Suitable materials for dielectric layer 708 include, without limitation, compounds of silicon dioxide, compounds of silicon nitride, compounds of silicon-oxy-nitrides, organic layers, and ceramic layers.

Electret layer 710 is an approximately 1 micron-thick layer of material suitable for being implanted with electric charge. Suitable materials for electret layer 710 include, without limitation, fluorinated polymers, polytetrafluoroethylene (PTFE), polyvinylidine difluoride (PVDF), and polyesters. Charge is implanted in electret layer 710 through the use of a back-lighted thyratron pulsed electron gun as is well-known in the art.

Spacer layer 712 determines the initial cavity length, $L_o$, of electret-based displacement sensors 302-1 and 302-2. In the alternative embodiment depicted in FIG. 7, spacer layer 712 is a 5 micron-thick layer of polyimide that has been etched to form chamber 716. Spacer layer 712 can comprise any material that can be formed sufficiently thin. In some alternative embodiments, spacer layer 712 can be a thickness other than 5 micron, such as any thickness in the range of 1 micron to 15 microns. The strength of output signals 308-1 and 308-2 is inversely proportional to the spacing between electret layer 710 and electrodes 714-1 and 714-2 (i.e., the thickness of spacer layer 712).

In operation, acoustic energy incident on displacement sensors 302-1 and 302-2 causes changes in their instantaneous cavity lengths, $L_1$ and $L_2$, respectively. As a result, output signals 308-1 and 308-1 are produced and provided to signal processor 106 as sensor signal 104.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising:

(1) a first sensor for generating a first output signal based on an environmental stimulus, wherein the first sensor comprises a first movable layer and a first surface, and wherein the first movable layer and the first surface are substantially parallel and form a first cavity having a first cavity length, and further wherein the first output signal is a function of the first cavity length; and (2) a second sensor for generating a second output signal based on the environmental stimulus, wherein the second sensor comprises a second movable layer and a second surface, and wherein the second movable layer and the second surface are substantially parallel and form a second cavity having a second cavity length, and further wherein the second output signal is a function of the second cavity length;

wherein the first sensor and the second sensor are physically-adapted to be operatively-coupled through a compressible fluid.

2. The apparatus of claim 1 further comprising a substrate, wherein the substrate comprises the first surface and the second surface.

3. The apparatus of claim 2 wherein the first layer and the second layer are substantially coplanar, and wherein the first surface and the second surface are substantially coplanar.

4. The apparatus of claim 1 wherein at least one of said first sensor and said second sensor comprises an electret.

5. The apparatus of claim 1 wherein at least one of said first sensor and said second sensor comprises a piezoelectric element.

6. The apparatus of claim 1 wherein at least one of said first sensor and said second sensor comprises an energy-resonant cavity.

7. The apparatus of claim 6 wherein the energy-resonant cavity is an optically-resonant cavity.

8. An apparatus comprising:

a first energy-resonant cavity having a first movable layer; and a second energy-resonant cavity having a second movable layer, wherein the first energy-resonant cavity and the second energy-resonant cavity are physically-adapted to be operatively-coupled through a compressible fluid.

9. The apparatus of claim 8 wherein the first energy-resonant cavity has a first cavity length that is a first function of an environmental stimulus, and wherein the second energy-resonant cavity has a second cavity length that is a second function of the environmental stimulus.

10. The apparatus of claim 8 wherein the first energy-resonant cavity comprises a first surface and a second surface, and wherein the first surface is a surface of a first movable layer, and wherein the second energy-resonant cavity comprises a third surface and a fourth surface, and further wherein the third surface is a surface of a second movable layer.

11. The apparatus of claim 10 further comprising a substrate, wherein the substrate comprises the second surface and the fourth surface.

12. The apparatus of claim 8 wherein at least one of the first energy-resonant cavity and the second energy-resonant cavity is an optically-resonant cavity.

13. The apparatus of claim 8 wherein the compressible fluid comprises air.

14. The apparatus of claim 8 wherein the first energy-resonant cavity has a first width and the second energy-resonant cavity has a second width, and wherein the first width and the second width are unequal.

15. An apparatus comprising a chamber, wherein the chamber comprises:

(1) a first sensor region, wherein the first sensor region comprises a first movable layer and a first surface, wherein the first movable layer and the first surface are substantially parallel and separated by a first cavity length; and (2) a second sensor region, wherein the second sensor region comprises a second movable layer and a second surface, wherein the second movable layer and the second surface are substantially parallel and separated by a second cavity length.

16. The apparatus of claim 15 wherein the first sensor region and the second sensor region are physically-adapted to be operatively-coupled through a compressible fluid.

17. The apparatus of claim 16 wherein the first movable layer and the second movable layer are physically-adapted to move in response to an environmental stimulus.

18. The apparatus of claim 15 wherein at least one of said first sensor region and said second sensor region comprises an electret.

19. The apparatus of claim 15 wherein at least one of said first sensor region and said second sensor region comprises a piezoelectric element.

20. The apparatus of claim 15 wherein at least one of the first sensor region and the second sensor region comprises an energy-resonant cavity.

21. The apparatus of claim 20 wherein the energy-resonant cavity is an optically-resonant cavity.

22. The apparatus of claim 20 further comprising an energy detector for receiving energy from the energy-resonant cavity and providing an electrical signal based on the intensity of the received energy.

23. An apparatus comprising:

a plurality of optically-resonant cavities, wherein each of the plurality of optically-resonant cavities has a movable layer and a surface, and wherein the movable layer and surface collectively define a cavity length, and wherein the cavity length is a function of an environmental stimulus, and further wherein the plurality of optically-resonant cavities are operatively-coupled through a compressible-fluid.

24. The apparatus of claim 23 further comprising a plurality of photodetectors, wherein each of the plurality of photodetectors is physically-adapted to receive optical energy from at least one of the plurality of optically-resonant cavities.

25. The apparatus of claim 23 further comprising a source of optical energy, wherein at least one of the plurality of optically-resonant cavities is physically-adapted to receive optical energy from the source.

26. The apparatus of claim 23 further comprising a processor for processing an electrical signal from at least one of the plurality of photodetectors.

27. A method comprising:

receiving a first signal from a first sensor, wherein the first sensor comprises a first movable layer and a first surface, and wherein the first movable layer and the first surface are substantially parallel and form a first cavity having a first cavity length, and wherein the first signal is a function of a change in the first cavity length in response to an environmental stimulus;

receiving a second signal from a second sensor, wherein the second sensor comprises a second movable layer and a second surface, and wherein the second movable layer and the second surface are substantially parallel and form a second cavity having a second cavity length, and wherein the second signal is a function of a change in the second cavity length in response to the environmental stimulus; and processing the first signal and the second signal;

wherein the first sensor and the second sensor are physically-adapted to be operatively-coupled through a compressible fluid.

28. The method of claim 27 further comprising providing the physical adaptation for operatively-coupling the first sensor and the second sensor, wherein the physical-adaptation comprises enabling the mass transport of the compressible fluid between the first sensor and the second sensor.

29. The method of claim 27 wherein at least a portion of one of the first signal and the second signal is based on the flow of the compressible fluid between the first cavity and the second cavity.

30. The method of claim 27 further comprising determining a directional component of the environmental stimulus, wherein the directional component is based on the processing of the first signal and the second signal.

31. The method of claim 30 wherein the directional component is a function of the times when the first energy-resonant cavity receives the environmental stimulus and when the second energy-resonant cavity receives the environmental stimulus.

32. The method of claim 30 wherein the directional component is based on the relative motion of the first cavity and the second cavity.

33. The method of claim 32 wherein the relative motion is a function of the mass transport of the compressible fluid between the first sensor and the second sensor.

* * * * *